US006545238B2

(12) United States Patent
Hsu et al.

(10) Patent No.: US 6,545,238 B2
(45) Date of Patent: Apr. 8, 2003

(54) KEY DEVICE WITH A SCISSORS MECHANISM

(75) Inventors: Chien-Shih Hsu, Taipei (TW); Mao-Sung Huang, Tao-Yuan Hsien (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 09/683,244

(22) Filed: Dec. 5, 2001

(65) Prior Publication Data

US 2002/0092750 A1 Jul. 18, 2002

(30) Foreign Application Priority Data

Dec. 13, 2000 (TW) ..... 89126532 A

(51) Int. Cl.[7] ..... H01H 13/70
(52) U.S. Cl. ..... 200/344
(58) Field of Search ..... 200/344, 341, 200/5 A, 512; 400/490, 491, 495

(56) References Cited

U.S. PATENT DOCUMENTS 5,779,030 A * 7/1998 Ikegami et al. ..... 200/344
5,898,145 A * 4/1999 Su ..... 200/344
5,924,553 A * 7/1999 Yeh ..... 200/344
6,156,985 A * 12/2000 Chiang ..... 200/344
6,297,461 B1 * 10/2001 Kamishima ..... 200/5 A

* cited by examiner

*Primary Examiner*—Elvin Enad
*Assistant Examiner*—M. Fishman
(74) *Attorney, Agent, or Firm*—Winston Hsu

(57) ABSTRACT

A key device includes a base plate, a keycap set above the base plate, a scissors mechanism between the base plate and the keycap, and an elastic component with a first end connected to the base plate and a second end connected to the first supporting arm. The scissors mechanism includes a first supporting arm and a second supporting arm for forming the scissors mechanism in an intersecting manner. The elastic component includes a first angle formed between the base plate and the elastic component, and the first angle is less than 90 degrees. While the keycap is depressed, the keycap moves downwards with the second end of the elastic component, the elastic component rotates around the first end of the elastic component to decrease the first angle, and the elastic component is stressed and deformed to support an upward spring force of the keycap.

10 Claims, 10 Drawing Sheets

KEY DEVICE WITH A SCISSORS MECHANISM

BACKGROUND OF THE INVENTION

1. Field of the Invention

The present invention relates to a key device, and more particularly, to a key device having a scissors mechanism.

2. Description of the Prior Art

Please refer to FIG. 1 and FIG. 2. FIG. 1 is a diagram of a key device 10 according to the prior art of U.S. Pat. Nos. 5,278,371, 5,746,308. FIG. 2 is a section view 2—2 of the key device 10 according to the prior art. The key device 10 comprises a keycap 12, a base plate 14, a rubber dome 16 for supporting the keycap 12 elastically, and a corresponding signal sensor 17 on an upper surface 18 of the base plate 14. An inner part of the rubber dome 16 comprises a contact strip 19 for triggering the signal sensor 17, and then producing a corresponding signal while the keycap 12 is depressed to a predetermined position.

While the keycap 12 is depressed, the keycap 12 will return to an original position due to an elastic restoring force of the rubber dome 16. After using the keycap 12 for a long period of time, the rubber dome 16 will become elastically fatigued, and the keycap 12 can not return to the original positionanymore, that is, the life of the keycap 12 will be reduced.

Furthermore, the above-mentioned design is very difficult to reduce a distance between the keycap 12 and the base plate 14 under limits of materials and shape of the rubber dome 16, and leads to a condition of insufficient spring force or bad touching feeling. With a movement toward smart notebook PCs, the prior art design can not conform to current requirements.

SUMMARY OF INVENTION

It is therefore a primary objective of the claimed invention to provide a key device with an elastic scissors device, which can adjust the elastically restoring force and have a lower height of keycap, and can operate for a long time to increase the life of the key device.

The claimed invention includes a key device comprising a base plate, a keycap set above the base plate, a scissors mechanism disposed between the base plate and the keycap, and an elastic component has a first end and a second end. The scissors mechanism comprises a first supporting arm and a second supporting arm for forming the scissors mechanism in an intersecting manner. The first end of the elastic component is connected to the base plate,and the second end of the elastic component is connected to the first supporting arm, and forming a first angle, of less than 90 degrees, between the base plate and the elastic component. While the keycap is depressed, the keycap moves downward with the second end of the elastic component, and the elastic component rotates around the first end of the elastic component to decrease the first angle. Then the elastic component is stressed and deformed to support an upward spring force of the keycap.

It is an advantage of the claimed invention that it can decrease the height of the keycap of the key device and not have the condition of elastic fatigue after using the key device for a long time. Furthermore, it can be designed to adjust freely the relationship between the downward displacement and the depressed force to conform to the needs of different conditions.

These and other objectives and the advantages of the claimed invention will no doubt become obvious to those of ordinary skill in the art after having read the following detailed description of the preferred embodiment which is illustrated in the various figures and drawings.

DETAILED DESCRIPTION

Figure 1:
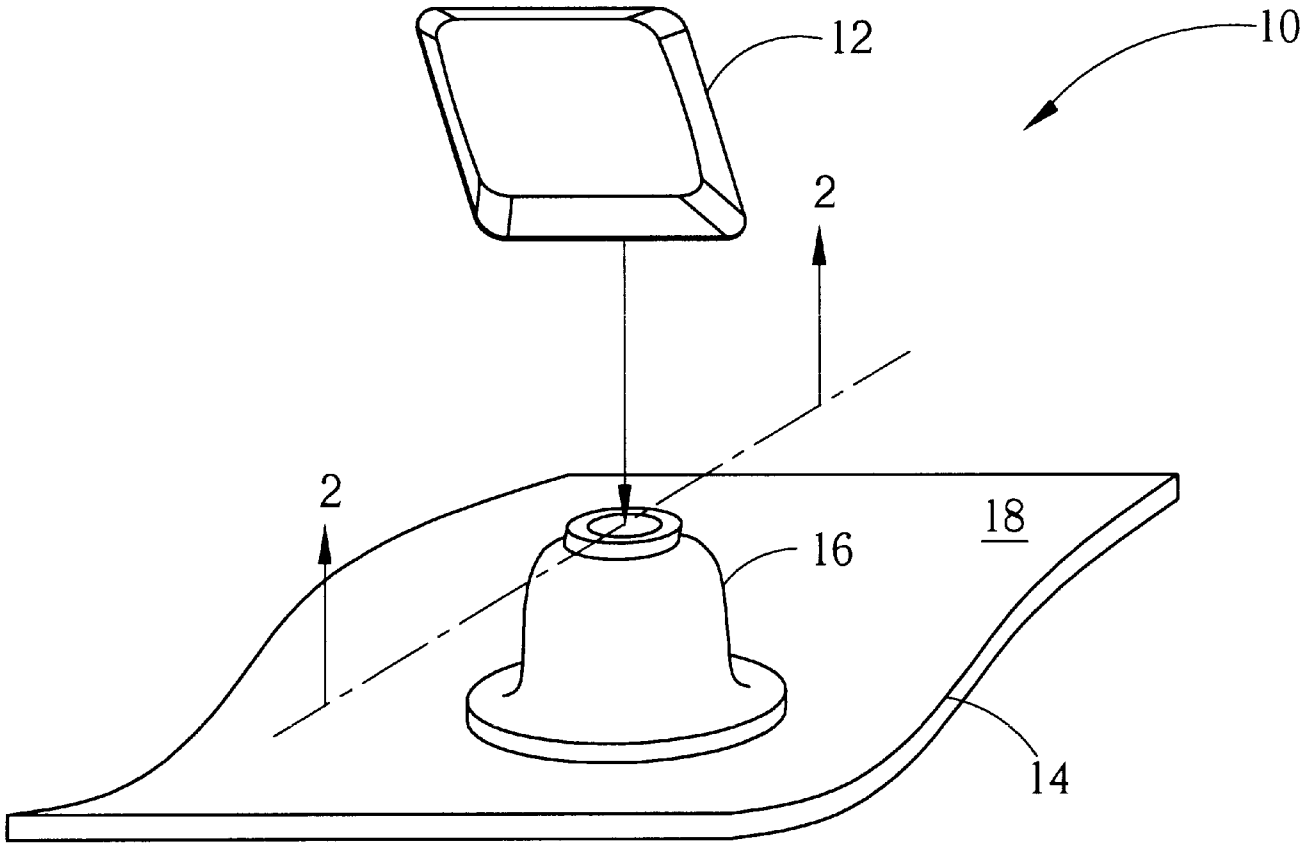
Fig. 1 Prior art
FIG. 1 is an exploded diagram of a key device according to the prior art.
Figure 2:
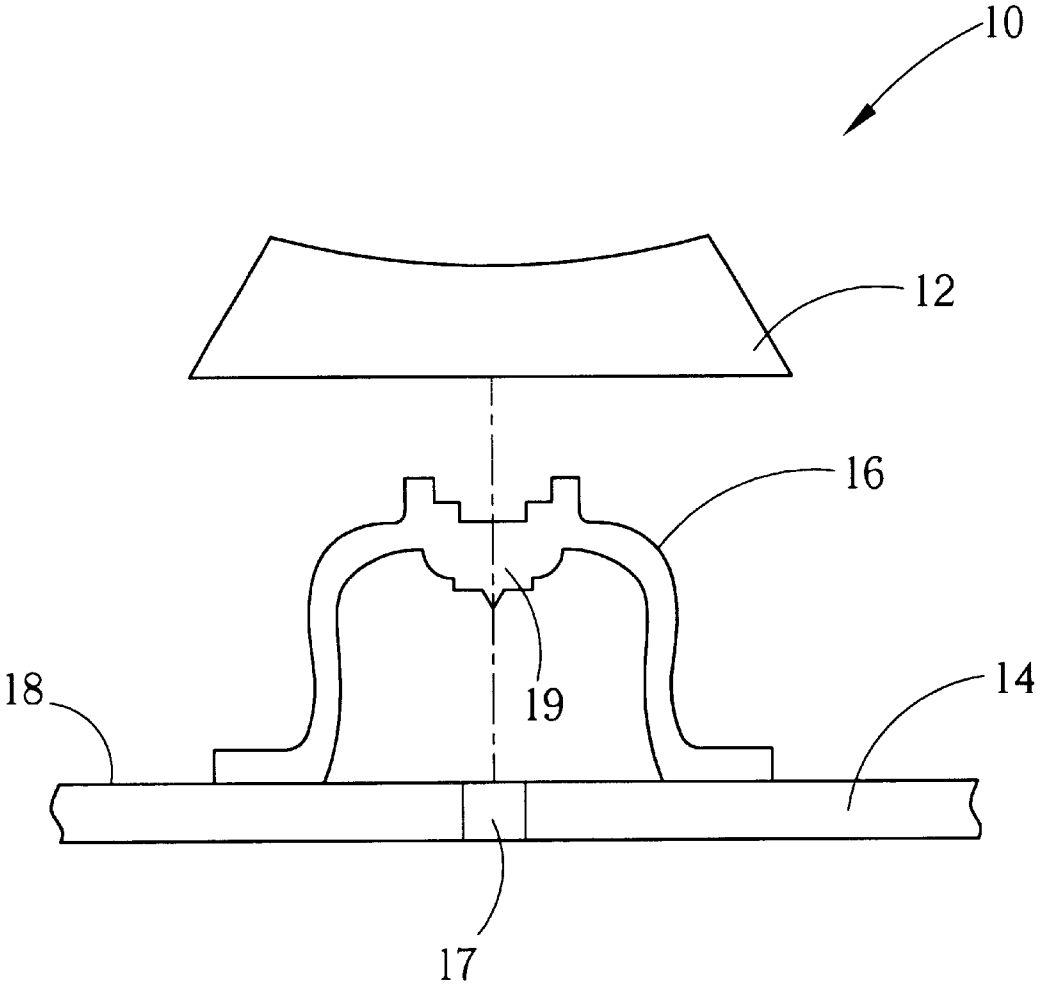
Fig. 2 Prior art
FIG. 2 is a section view 2—2 of the key device shown in FIG. 1.
Figure 3:
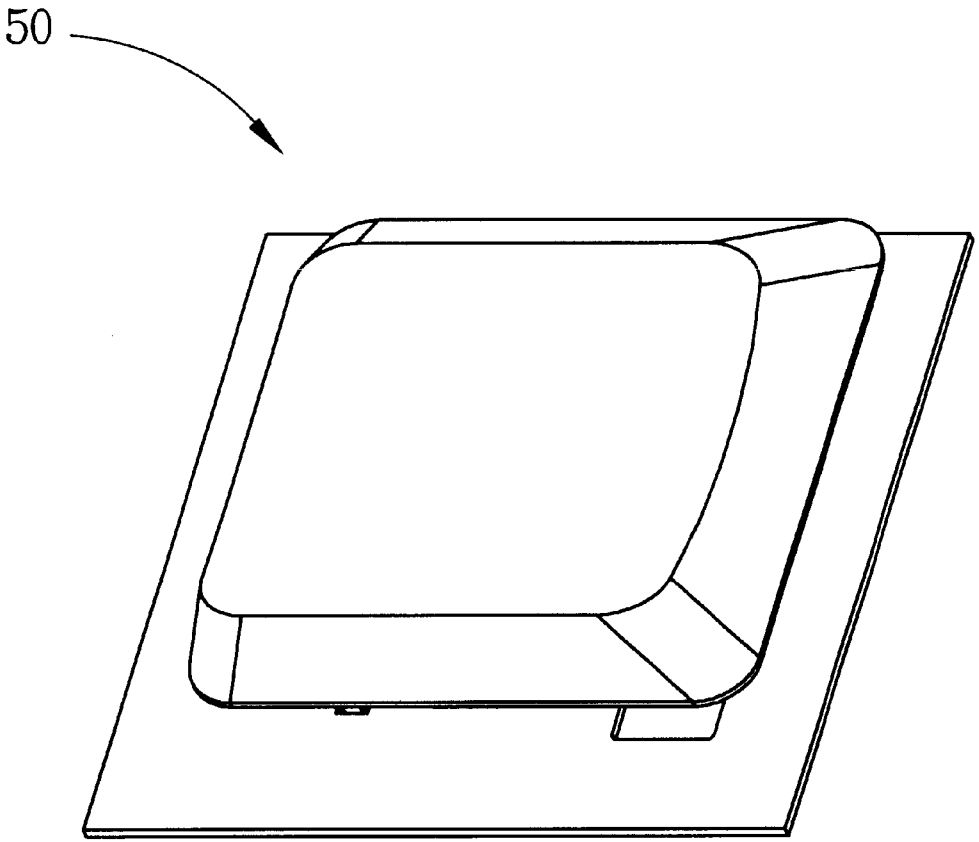
FIG. 3 is a perspective view of a key device according to the present invention.
Figure 4:
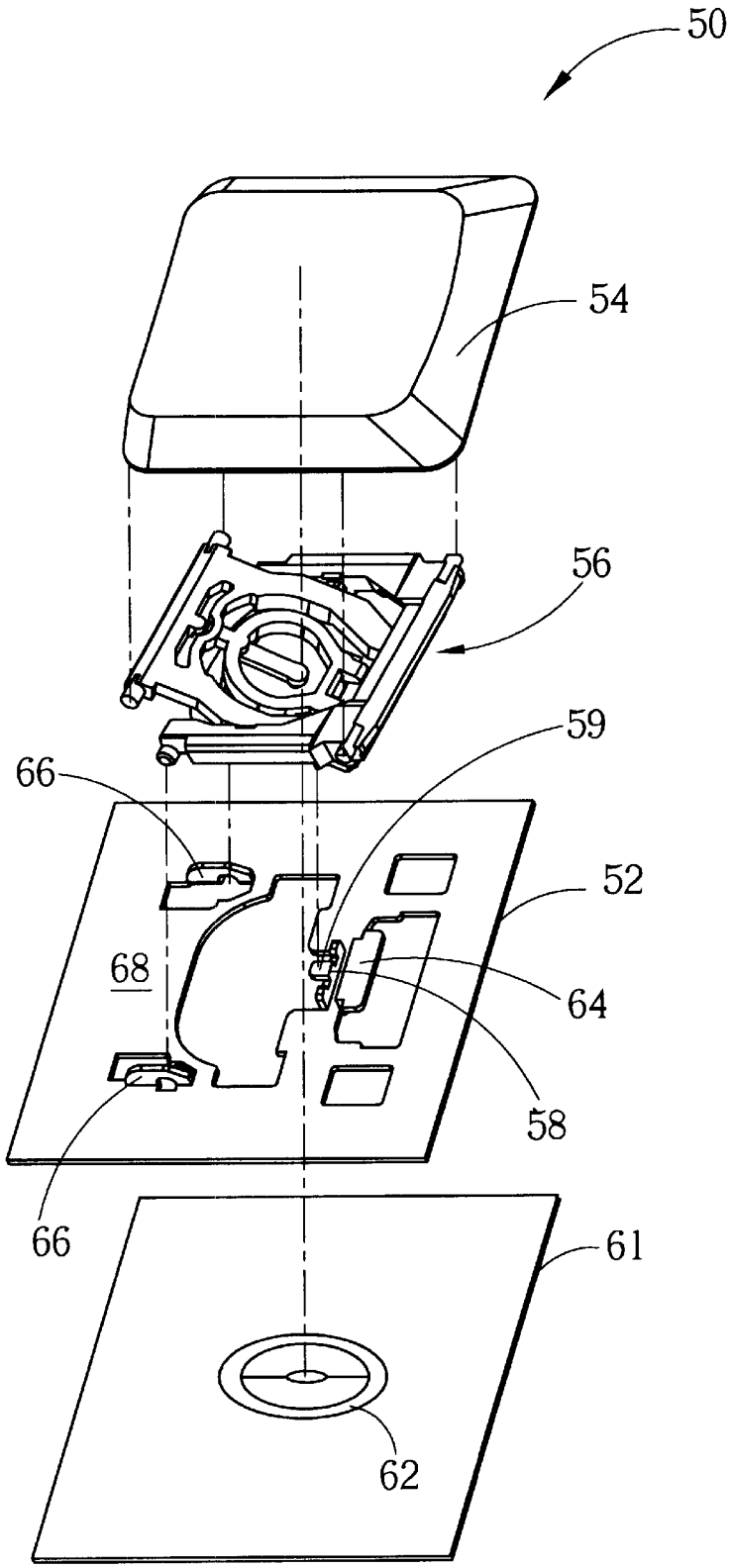
FIG. 4 is an exploded diagram of the key device in FIG. 3.

Please refer to FIG. 3 and FIG. 4. FIG. 3 is a perspective view of the key device 50, and FIG. 4 is an exploded view of the key device 50. The key device 50 comprises a base plate 52, a keycap 54 set above the base plate 52, a scissors mechanism 56 between the base plate 52 and the keycap 54 for supporting an upward spring force of the keycap 54, and a membrane circuit board 61. The key device 50 further comprises a stopper 58, a blocking piece 59 that is approximately perpendicular to the stopper 58, a hinge 64, a pair of sliding slots 66 set on the upper surface 68 of the base plate 52, and a touch sensor 62. The touching sensor 62 is set on the membrane circuit board 61 for producing a signal when the keycap 54 is depressed.

Figure 5:
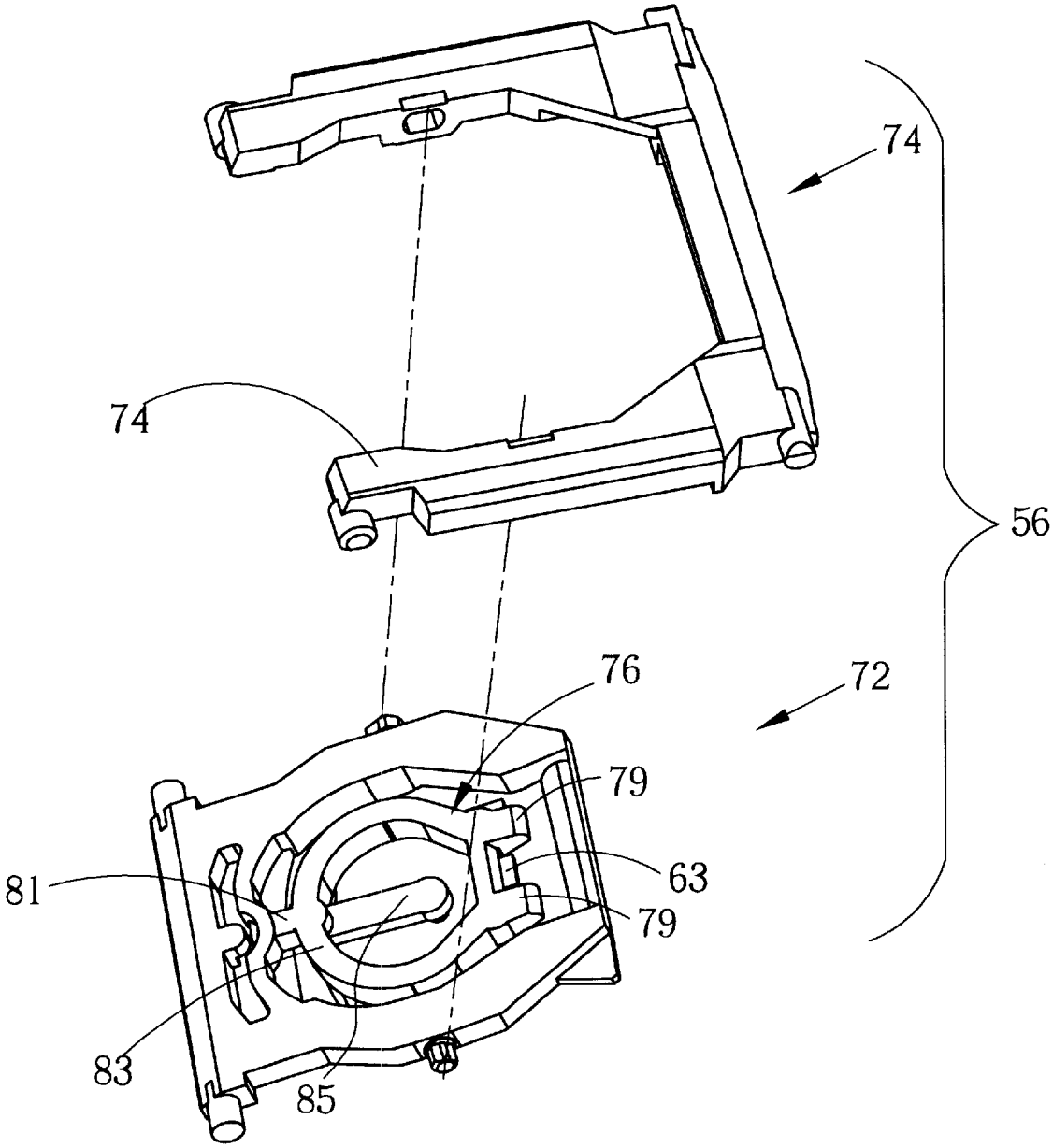
FIG. 5 is an exploded diagram of the scissors mechanism of the key device in FIG. 4.
Figure 6A:
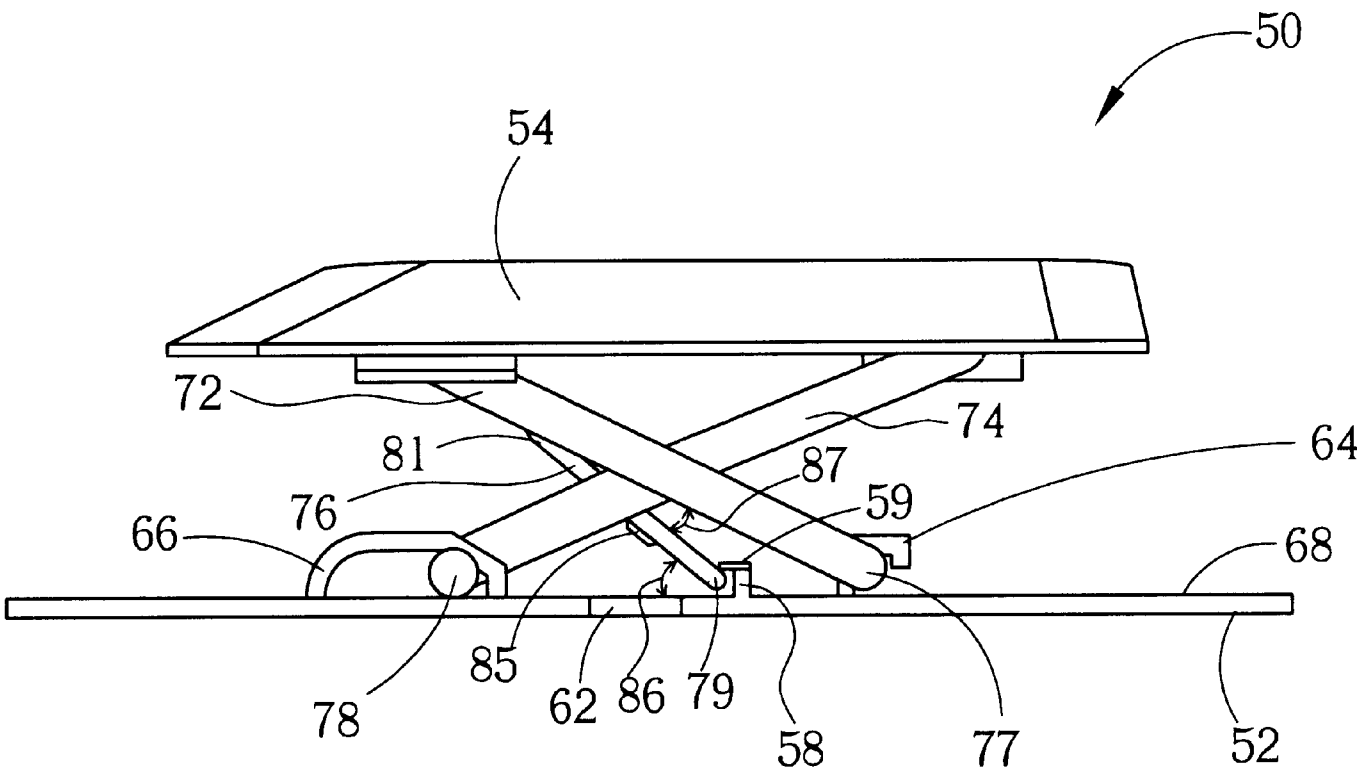
FIG. 6A is a side view of the key device in FIG. 3.

Referring to FIG. 5 and FIG. 6A, FIG. 5 is the exploded diagram of the scissors mechanism as shown in FIG. 4, and FIG. 6A is a side view of the key device 50 in FIG. 3. The scissors mechanism 56 comprises a first supporting arm 72 and a second supporting arm 74 for forming the scissors mechanism in an intersection manner. The scissors mechanism 56 further comprises an elastic component 76. The elastic component 76 and the first supporting arm 72 are monolithically formed and are made of rubber material. The elastic component 76 comprises a first angle 86, being less than 90 degrees, formed between the elastic component 76 and the base plate 52, and a second angle 87 formed between the first supporting arm 72 and the elastic component 76. The first angle 86 and second angle 87 will be reduced when the keycap 54 is depressed.

As shown in FIG. 5 and FIG. 6A, a lower end 77 of the first supporting arm 72 is pivotally fixed at a hinge 64, and a lower end 78 of the second supporting arm 74 is slidably fixed within a sliding slot 66 on an upper surface 68 of the base plate 52. The elastic component 76 has a first end 79 and a second end 81. The first end 79 is connected to stopper 58 of the upper surface 68 of the base plate 52, and the second end 81 is connected with the first supporting arm 72.

The stopper 58 is positioned between the hinge 64 and the touching sensor 62.

The elastic component 76 further comprises a ringlike structure 83 with a contact strip 85 at the center of the ringlike structure 83. The ringlike structure 83 of the elastic component 76 will be stressed and deformed to decrease a distance between the first end 79 and the second end 81 of the elastic component 76 while the keycap 54 is depressed.

At this time, the contact strip 85 of the elastic component 76 triggers the touching sensor 62 to produce a corresponding signal. When the force is removed from the keycap 54, the deformed ringlike structure 83 tends to recover its original shape and the scissors mechanism 56 will support the keycap 54 elastically. When the keycap 54 is depressed, the keycap 54 and the second end 81 of the elastic component 76 moves downwards and the elastic component 76 rotates around the first end 79 of the elastic component 76 to decrease the first angle 86 and the second angle 87. Then, the elastic component 76 is stressed and deformed to provide an upward supporting spring force for the keycap 54.

Figure 6B:
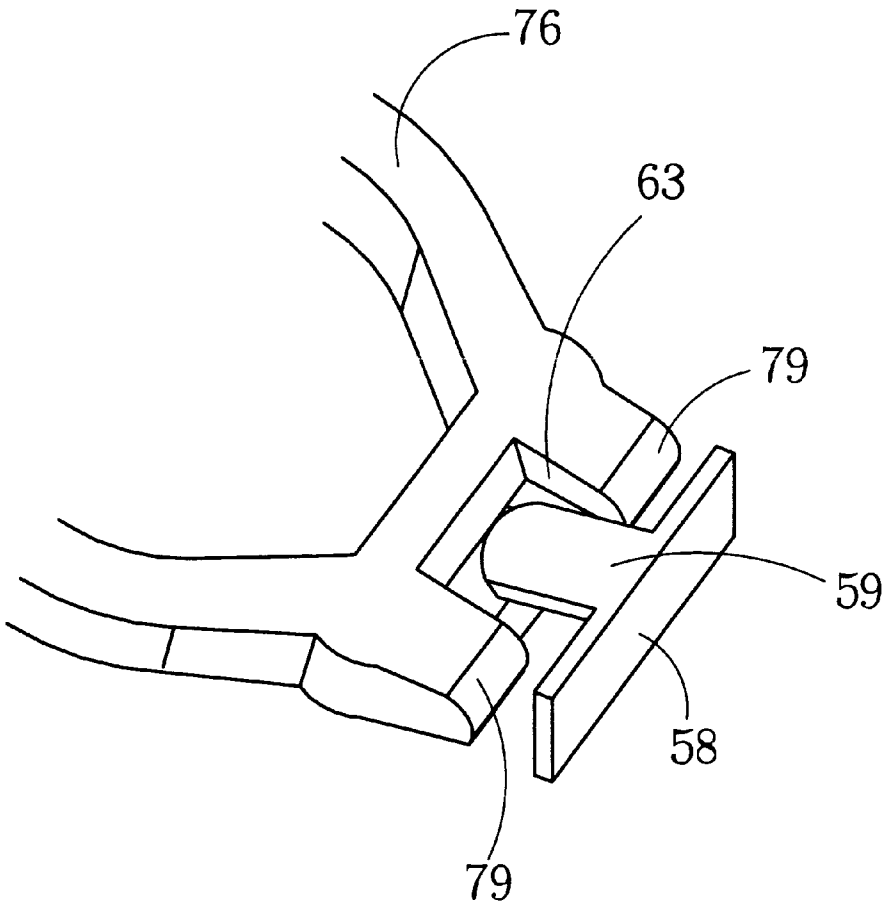
FIG. 6B is a diagram of the elastic component connected to the stopper in FIG. 6A.

Referring to FIG. 6B, FIG. 6B is a diagram of the elastic component 76 connected to the stopper 58. As shown in FIG. 6B, the stopper 58 comprises a blocking piece 59 formed on an upper end of the stopper 58.The elastic component 76 has an opening 63 at the first end 79 for accommodating the blocking piece 59. The opening 63 is positioned below the blocking piece 59. Therefore, the first end 79 of the elastic component 76 is rotatably disposed under the blocking piece 59.

Figure 7:
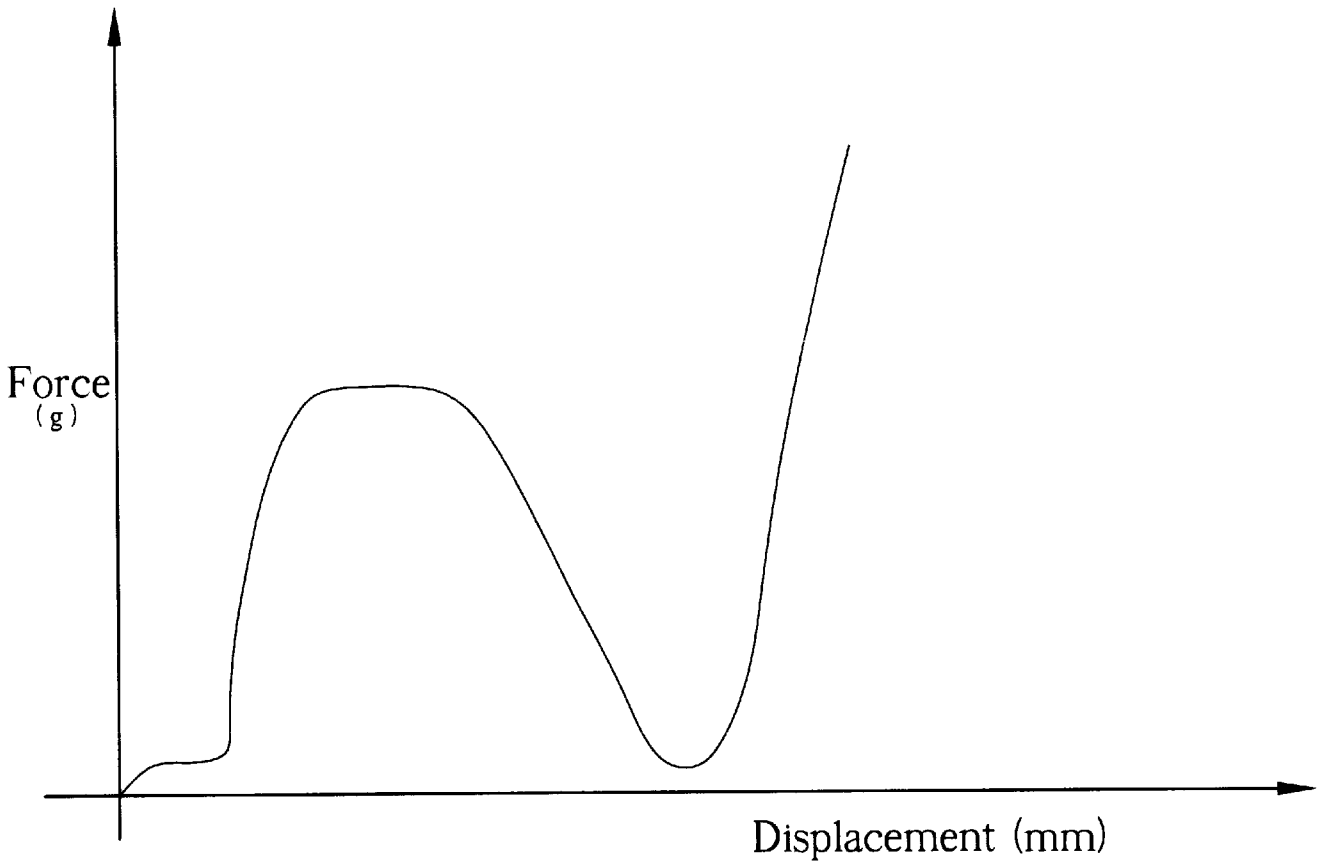
FIG. 7 shows a relationship between a depressed force and a downward displacement.

Referring to FIG. 7, FIG. 7 shows a relationship between the depressed force and the downward displacement of the key device 50 being depressed. A designer can get different displacement-force diagrams of the key device 50 by choosing the materials of the elastic component 76 differently; by deciding if the elastic component 76, connected to the first arm 72 or the second arm 74 of the scissors mechanism 56, is fixed or not; and, while the elastic component 76 is fixed on the upper surface 68 of the base plate 52 or not, by choosing the angle between the elastic component 76 and the scissors mechanism 56. So, the key device 50 is a key device having a flexible elastic restoring force.

Figure 8:
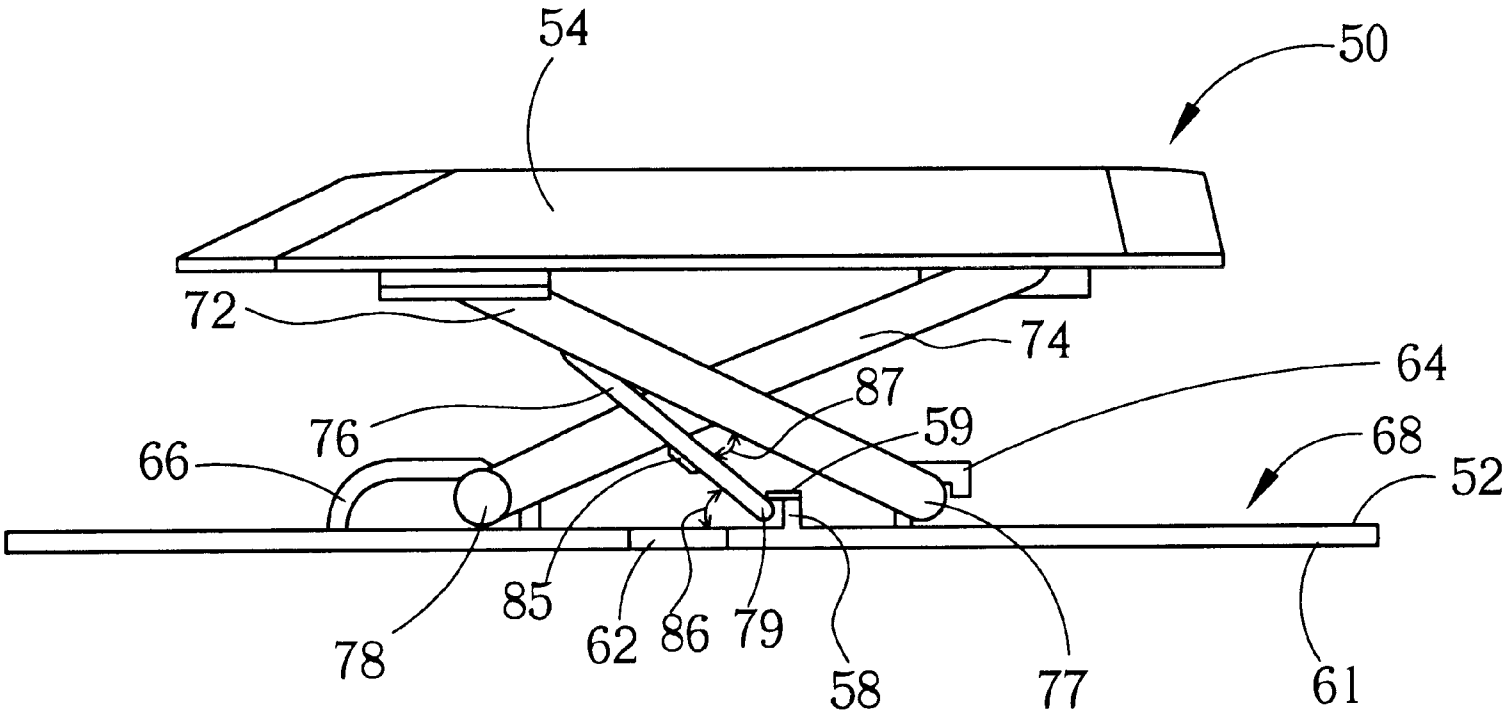
FIG. 8 is a side view of the key device in FIG. 3 moving upwards.
Figure 9:
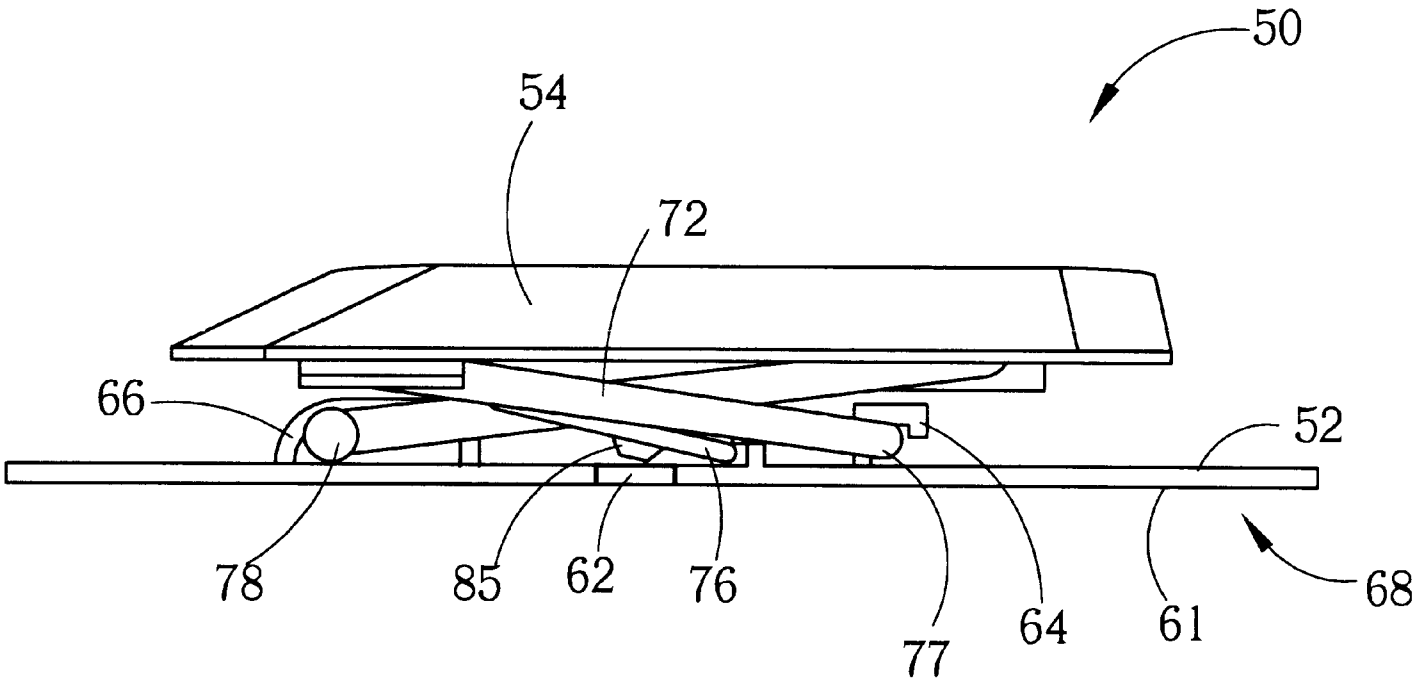
FIG. 9 is a side view of the key device in FIG. 3 when triggering a touch sensor.

Please refer to FIG. 8 and FIG. 9. FIG. 8 is a side view of the key device 50 moving upwards, and FIG. 9 is a side view of the key device 50 when triggering the touching sensor 62. The key device 50 comprises a base plate 52, a keycap 54 set above the base plate 52, a scissors mechanism 56 between the base plate 52 and the keycap 54 for supporting the keycap 54 elastically, and a membrane circuit board 61 beneath the base plate 52. The key device 50 further comprises a stopper 58, a hinge 64, a pair of sliding slots 66 set on the upper surface 68 of the base plate 52, and a touching sensor 62 set on the membrane circuit board 61. The touching sensor 62 will produce a signal corresponding to depression of the keycap 54. The scissors mechanism 56 comprises a first supporting arm 72 and a second supporting arm 74 for forming the scissors mechanism 56 in an intersecting manner. The scissors mechanism 56 further comprises an elastic component 76. The elastic component 76 and the first supporting arm 72 are monolithically formed and are made of rubber material.The first supporting arm 72 is fixed on the base plate 52 by the hinge 64 of the upper surface 68, the second supporting arm 74 is slidably disposed within the sliding slot 66 on the upper surface 68 of the base plate 52.

The elastic component 76 is capable of combining with the second supporting arm 74, and may be made of rubber materials. Under these conditions, the first end 79 of the elastic component 76 is contacted under the blocking piece 59 above the stopper 58 on the upper surface 68 of the base plate 52, and the second end 72 of the elastic component 76 is connected to the second supporting arm 74.

The elastic component 76 is stressed and deformed to decrease the length between the first end 79 and the second end 81 of the elastic component 76 while the keycap 54 is depressed. Then the contact strip 85 of the ringlike structure 83 will move downwards to trigger the touching sensor 62 and producing a corresponding signal. While the force is removed, the scissors mechanism 56 produces an upward spring force for supporting the key device 54. While the keycap 54 is depressed, the keycap 54 moves downward with the second end 81 of the elastic component 76, and the elastic component 76 rotates around the first end 79 of the elastic component 76 to decrease the first angle 86 and the second angle 87. At the same time, the elastic component 76 is stressed and deformed so that the length between the first end 79 and the second end 81 of the elastic component is reduced, andprovidingan upward supporting spring force of the keycap 54.

Compared with the prior art, the key device of the present invention, utilizing a scissors mechanism for supporting the keycap of the key device, not only does not exhibit elastic fatigue, but also designs and adjusts the displacement-force relationship freely when used for a long time. Furthermore, it can decrease the height of the keycap of the key device to conform to requirements of notebook PCs.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A key device comprising:

a base plate;

a keycap set above the base plate;

a scissors mechanism between the base plate and the keycap, having a first supporting arm and a second supporting arm for forming the scissors mechanism in an intersecting manner; and an elastic component with a first end connected to the base plate and a second end connected to the first supporting arm having a first angle formed between the base plate and the elastic component, the first angle being less than 90 degrees;

wherein while the keycap is depressed, the keycap with the second end of the elastic component is moved downwards, the elastic component rotates around the first end of the elastic component for decreasing the first angle, and the elastic component is stressed and deformed for providing an upward supporting spring force of the keycap.

2. The key device of claim 1 further comprising a sliding slot disposed on an upper surface of the base plate, wherein a lower end of the second supporting arm is slidably disposed within the sliding slot.

3. The key device of claim 1 further comprising a hinge disposed on an upper surface of the base plate, wherein a lower end of the first supporting arm is rotatably fixed on the base plate by the hinge.

4. The key device of claim 1 further comprising a sliding slot disposed on an upper surface of the base plate, wherein a lower end of the first supporting arm is slidably disposed within the sliding slot.

5. The key device of claim 1 further comprising a hinge disposed on an upper surface of the base plate, wherein a lower end of the second supporting arm is rotatably fixed on the base plate by the hinge.

6. The key device of claim 1 further comprising a stopper disposed between a lower end of the first supporting arm and a lower end of the second supporting arm on an upper surface of the base plate, wherein the first end of the elastic component is positioned against the stopper.

7. The key device of claim 6 wherein the stopper comprises a blocking piece formed on an upper end of the stopper, the elastic component having an opening at the first end for accommodating the blocking piece, the opening being positioned below the blocking piece so that the first end of the elastic component is rotatably disposed under the blocking piece.

8. The key device of claim 1 wherein the elastic component and the first supporting arm are monolithically formed, the first supporting arm and the elastic component forming a second angle which decreases while the keycap is depressed.

9. The key device of claim 1 wherein the elastic component has a ringlike structure, which is stressed and deformed to decrease a distance between the first end and the second end of the elastic component while the keycap is depressed.

10. The key device of claim 1 further comprising a touching sensor beneath the scissors mechanism, wherein the elastic component further comprises a contact strip for triggering the touching sensor and then producing a corresponding signal while the keycap is depressed and the elastic component rotating to a predetermined angle.

* * * * *